United States Patent [19]

Kitamura et al.

[11] Patent Number: 4,996,496

[45] Date of Patent: Feb. 26, 1991

[54] BENDING MAGNET

[75] Inventors: Masashi Kitamura; Takashi Kobayashi; Shunji Kakiuchi; Kiyoshi Yamaguchi; Hiroshi Tomeoku, all of Hitachi; Naoki Maki, Ibaraki; Jyoji Nakata, Kawasaki; Yasumichi Uno, Isehara, all of Japan

[73] Assignees: Hitachi, Ltd.; Nippon Telegraph and Telephone Corp., both of Tokyo, Japan

[21] Appl. No.: 242,126

[22] Filed: Sep. 9, 1988

[30] Foreign Application Priority Data

Sep. 11, 1987 [JP] Japan ..... 62-226362

[51] Int. Cl.[5] ..... H05H 13/04

[52] U.S. Cl. ..... 328/228; 328/230; 328/233; 328/235; 335/216

[58] Field of Search ..... 328/228–230, 328/233, 235; 335/216; 313/62

[56] References Cited

U.S. PATENT DOCUMENTS

| | | | |
|---|---|---|---|
| 4,200,844 | 4/1980 | Nunan | 328/230 |
| 4,737,727 | 4/1988 | Yamada et al. | 328/235 |
| 4,751,470 | 6/1988 | Ikegami et al. | 328/233 |
| 4,806,871 | 2/1989 | Ikegami et al. | 328/235 |
| 4,853,640 | 8/1989 | Matsumoto et al. | 328/233 |

FOREIGN PATENT DOCUMENTS

| | | |
|---|---|---|
| 282988 | 9/1988 | European Pat. Off. . |
| 61-80800 | 4/1986 | Japan . |
| 62-140400 | 6/1987 | Japan . |
| 62-186500 | 8/1987 | Japan . |

OTHER PUBLICATIONS

Hitachi Review vol. 34, No. 3, Jun. 85 pp. 137–140, Noda et al; Outline of Bending Magnet for Tarn II.

*Primary Examiner*—Donald J. Yusko
*Assistant Examiner*—Michael Horabik
*Attorney, Agent, or Firm*—Antonelli, Terry, Stout & Kraus

[57] ABSTRACT

In a bending magnet, a core which is substantially sectoral or semi-circular in horizontally sectional configuration and in which opposed magnetic poles are formed and a vacuum chamber for storage of a charged particle beam is disposed in a gap between the opposed magnetic poles, and a pair of upper and lower exciting coils for generating a bending magnetic field in the gap between the magnetic poles of core, the reluctance against the magnetic flux passing through a portion of the core adjacent to the inner circumference of the orbit of the charged particle beam and a portion of the core adjacent to the outer circumference of the charged particle beam orbit is equally uniformed over the overall length of the orbit of the charged particle beam. With this construction, the magnetic flux density becomes uniform in the gap between magnetic poles where the magnetic flux passing through the inner and outer circumference side portions is concentrated and the magnetic flux distribution is uniformed in the orbital direction in the gap, thereby eliminating adverse influence upon the charged particle beam, and the bending magnet can be very effective for use in a synchrotron or a storage ring.

10 Claims, 3 Drawing Sheets

BENDING MAGNET

BACKGROUND OF THE INVENTION

This invention relates to bending magnets and more particularly to a bending magnet suitable for use in a synchrotron adapted to generate a synchrotron radiation (SR) or in a storage ring.

The SR is an electromagnetic wave which radiates from an electron e moving at a velocity approximating the velocity of light when the orbit of the electron is bent by a magnetic field H and because of strong directivity which is tangential to the orbit, the SR has many applications including, for example, a very effective use as a soft X-ray source for transfer of fine patterns of electronic parts.

The bending magnet is used to generate the magnetic field H which bends the orbit of the electron e for the sake of obtaining the SR.

As an example of the bending magnet, a superconducting bending magnet for use in a charged particle accelerator is disclosed in Japanese patent unexamined publication JP-A-61-80800. This example intends to generate a strong magnetic field of about 3 teslas, and has an iron core having upper and lower magnetic poles and upper and lower superconducting coils wound on the upper and lower poles, respectively. When the vertical distance between coil segments of the upper and lower coils disposed in the inner side of the orbit is $h_1$ and the distance between the coil segments of the upper and lower coils disposed in the outer side of the orbit is $h_2$, the bending magnet is divided into three areas in the direction of the orbit of charged particle beam and the superconducting coils are disposed such that the vertical distances $h_1$ and $h_2$ satisfy $h_1>h_2$, $h_1=h_2$ and $h_1<h_2$ in the three areas, respectively. The iron core encloses the overall length of the coils. The superconducting coils generate a strong magnetizing force by which the magnetic poles are strongly saturated.

Thus, in the area of bending magnet where $h_1>h_2$ holds, the bending magnetic field is stronger on the outer circumference side than on the inner circumference side to produce a magnetic field which causes the charged particle beam to diverge in a direction perpendicular to the orbital plane of the charged particle beam. In the area where $h_1<h_2$ holds, the bending magnetic field is weaker on the outer circumference side than on the inner circumference side to produce a magnetic field which causes the charged particle beam to converge in the aforementioned direction. In the area where $h_1=h_2$ holds, the magnetic field on the inner circumference side is equal to that on the outer circumference side and the bending magnetic field becomes uniform. Accordingly, the bending magnet per se is effective to converge or diverge the charged particle beam and is suitable for realization of a strongly focusing type synchrotron or storage ring removed of quadrupole magnet.

In the prior art, the vertical distance $h_1$ between the inner circumference side coil segments is made to be equal to the vertical distance $h_2$ between the outer circumference side coil segments for the purpose of obtaining the uniform bending magnetic field. However, since, in the prior art, magnetic saturation of the magnetic poles of the iron core was not fully taken into consideration, it was difficult to obtain sufficient uniformity of the magnetic field even if the coils were disposed to satisfy $h_1=h_2$ upon detailed magnetic field calculation in consideration of non-linearity of iron core and experimental study. Thus, the prior art coil arrangement is unsuitable for the bending magnet. Especially, in a synchrotron or a storage ring in which the number of bending magnets is small, one bending magnet shares a large bending angle for the charged particle beam and the magnet configuration is sectoral or semi-circular, with the result that the non-uniformity of magnetic field is aggravated. Further, the prior art suggests a coil arrangement of making the vertical distance between inner circumference side coil segments different from the vertical distance between outer circumference side coil segments for causing the magnetic field to converge or diverge but nothing about improvement of uniformity of magnetic field. In conclusion, the prior art in no way takes into account improving the uniformity of magnetic field over the overall length of the orbit of charged particle beam in the bending magnet.

Japanese patent unexamined publications JP-A-62-186500 and JP-A-62-140400 also disclose a superconducting bending magnet, but none of these publications suggests anything about the above problem to be solved by the present invention.

SUMMARY OF THE INVENTION

The present invention contemplates elimination of the prior art drawbacks and has for its object to provide a bending magnet which can generate a strong and uniform bending magnetic field over the overall length of the orbit of charged particle beam even when the bending magnet has the form of a sector or semi-circle.

According to the invention, to accomplish the above object, in a bending magnet comprising an iron core which is substantially sectoral or semi-circular in horizontally sectional configuration and in which opposed magnetic poles are formed and a vacuum chamber for storage of a charged particle beam is disposed in a gap between the opposed magnetic poles, and a pair of upper and lower exciting coils for generating a bending magnetic field in the gap between the magnetic poles of the iron core, wherein the paired exciting coils are arranged such that the coil sections on a plane vertical to the orbit of the charged particle beam are asymmetrically disposed at the inner and outer circumferential sides with respect to the center line of the magnetic poles so as to make uniform the distribution of the magnetic flux generated in the gap between the magnetic poles of the iron core or the vertical distance between the coil segments of the exciting coils disposed at the outer circumferential side of the orbit is larger than the vertical distance between the coil segments disposed at the inner circumferential side of the orbit so as to make uniform the distribution of the magnetic flux in the vacuum chamber in the radial direction and also over the whole length of the charged particle beam orbit.

DESCRIPTION OF THE PREFERRED EMBODIMENTS

The invention will now be described by way of example with reference to the accompanying drawings.

Figure 1:
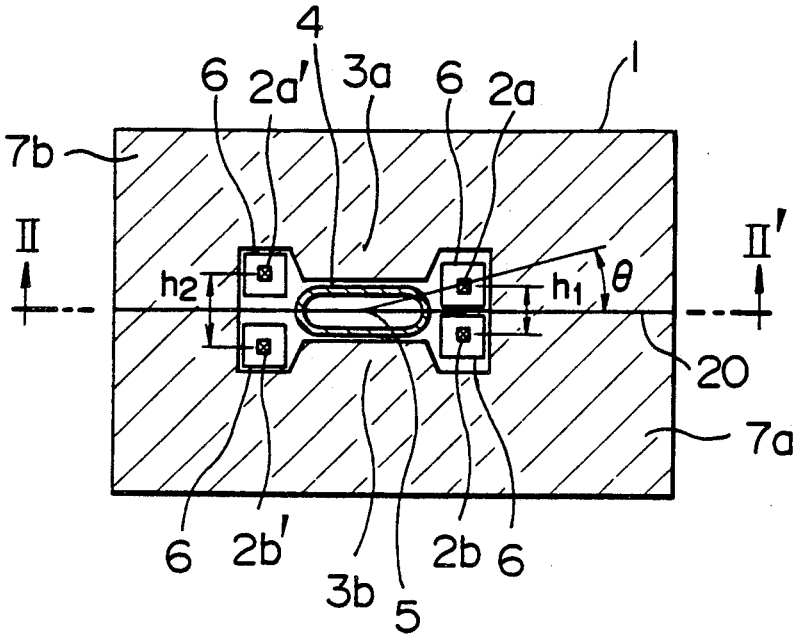
FIG. 1 is a sectional view illustrating a bending magnet according to an embodiment of the invention.
Figure 2:
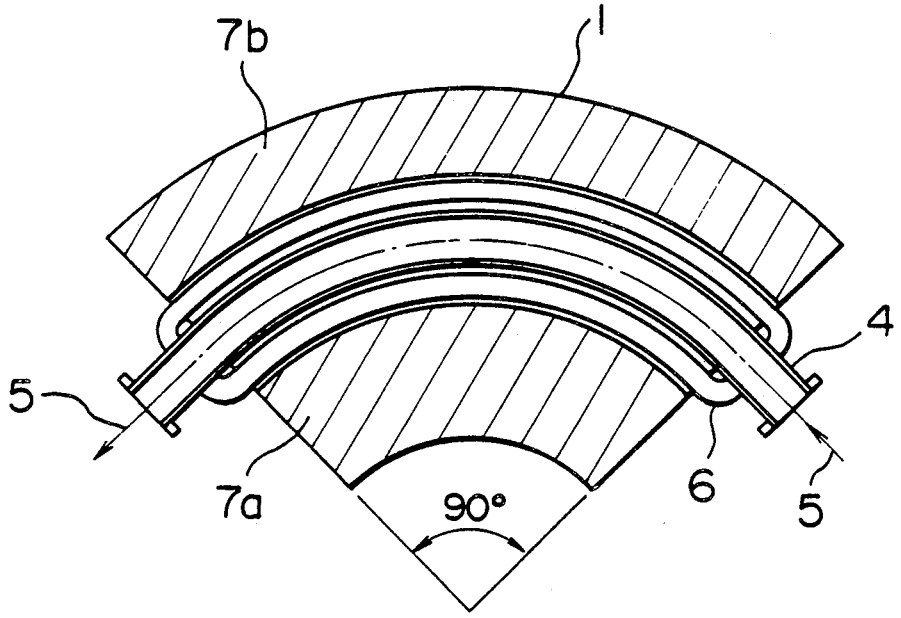
FIG. 2 is a sectional view taken on the line II—II' of FIG. 1.

FIGS. 1 and 2 illustrate a bending magnet according to an embodiment of the invention.

As shown, a pair of opposed cryostats 6 each incorporating a superconducting coil are placed in a cavity formed in a core 1 maintained at normal temperature and an upper superconducting coil having segments 2*a* and 2*a*' (hereinafter referred to as an upper superconducting coil 2*a*, 2*a*') and a lower superconducting coil having segments 2*b* and 2*b*' (hereinafter referred to as a lower superconducting coil 2*b*, 2*b*') are so disposed as to be symmetrical with respect to the obital plane of a charged particle beam 5. In this embodiment, a vertical distance $h_2$ between the coil segments 2*a*' and 2*b*' of the upper and lower superconducting coils disposed at the outer circumference side of the orbit of the charged particle beam 5 is made to be larger than a vertical distance $h_1$ between the coil segments 2*a* and 2*b* of the upper and lower superconducting coils disposed at the inner circumference side of the orbit, and the horizontal width of a return yoke 7*b* disposed at the outer circumference side of the orbit is made to be smaller than that of a return yoke 7*a* disposed at the inner circumference side of the orbit so that the sectional configuration of the inner circumference side return yoke and the sectional configuration of the outer circumference side return yoke are asymmetrical with respect to the center line of the magnetic poles. Accordingly, the magnetic flux density is equally uniformed in the inner and outer circumference side return yokes 7*a* and 7*b* and in a magnetic circuit of the bending magnet, the magnetic flux undergoes the same reluctance in the inner and outer circumference side return yokes 7*a* and 7*b*. Magnetic poles 3*a* and 3*b* oppose to each other through a gap in the core 1 maintained at normal temperature and the magnetic circuit comprised of the core 1 and upper superconducting coil 2*a*, 2*a*' and lower superconducting coil 2*b*, 2*b*' generates a bending magnetic field in the gap between the magnetic poles 3*a* and 3*b*. A vacuum chamber 4 is disposed in the gap and the charged particle beam 5 circulates through the vacuum chamber.

The plan configuration of the superconducting bending magnet will be better understood when explained with reference to FIG. 2.

FIG. 2 shows a sectional structure of the bending magnet having a bending angle of 90° for the charged particle beam 5. The bending angle may be any angle obtained by dividing 360° by an integer n which is 2 or more. However, since the configuration of the bending magnet approximates a linear bending magnet for n being large, the value of n may preferably approximate 2 or 4.

Referring to FIG. 2, the sectional configuration of the core 1 is sectoral and the arcuate vacuum chamber 4 through which the charged particle beam 5 circulates is disposed in the gap formed centrally of the iron core 1. The sectional configuration of each of the inner and outer circumference side return yokes 7*a* and 7*b* is also sectoral. The coil segments constituting each of the upper superconducting coil 2*a*, 2*a*' and the lower superconducting coil 2*b*, 2*b*' are connected, together with cryostat 6, at opposite ends of the bending magnet and the connecting portions are bent up or down so as not to interfere spatially with the vacuum chamber 4.

As described above, since in the present embodiment the configuration of the superconducting bending magnet is sectoral, the magnetic flux passing through the inner and outer circumference side return yokes can be equally uniformed over the overall length in the orbital direction of the charged particle beam 5 by widening the vertical distance between the outer circumference side coil segments 2*a*' and 2*b*' in order to uniform the magnetic flux distribution of the bending magnetic field generated in the gap between magnetic poles 3*a* and 3*b* where the magnetic flux passing through the inner and outer circumference side return yokes is concentrated. In this manner, the adverse influence due to non-uniformity of bending magnetic field upon the charged particle beam can be eliminated.

Figure 3:
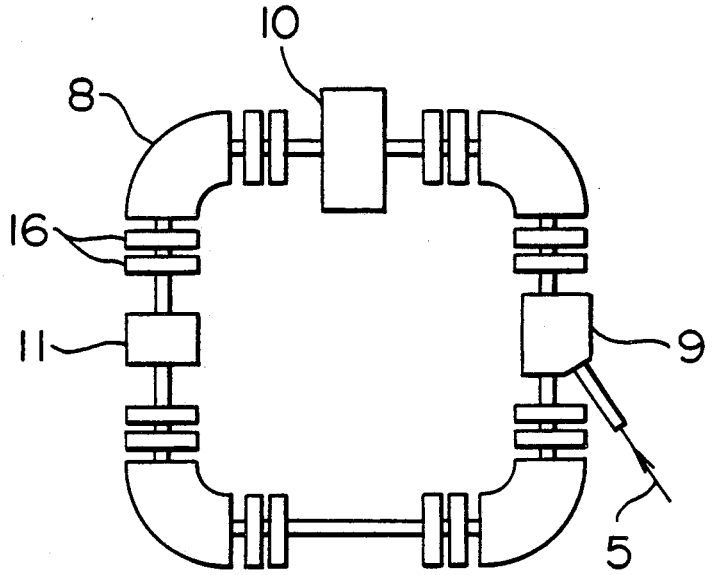
FIG. 3 is a plan view of a storage ring employing bending magnets according to the invention.

Thus, the charged particle beam can be 90° bent under the influence of a strong bending magnetic field generated by the superconducting coils. An example of a storage ring using the bending magnets is illustrated in FIG. 3. Referring to FIG. 3, reference numeral 8 designates the bending magnet in accordance with the above embodiment, 9 a septum magnet by which the charged particle beam is injected, 10 a radio frequency cavity for accelerating the charged particle beam, 16 a quadrupole magnet for focus or defocus of the charged particle beam 5, and 11 a kicker magnet which is a pulse magnet adapted to make easy the injection of the charged particle beam 5 by slightly shifting the orbit of the charged particle beam 5. In the example of FIG. 3, four of the bending magnets in accordance with the above embodiment are used in combination with other components to form the storage ring of the charged particle beam 5. The storage ring using the superconducting bending magnets according to the invention to make the bending magnetic field strong can store a charged particle beam 5 having energy which is higher by an increased bending magnetic field than that stored in a storage ring of the same scale based on normal conductivity. Accordingly, by adopting the bending magnets according to the present embodiment, a synchrotron or storage ring of charged particle beam with the sectoral superconducting bending magnets can be provided by which a charged particle beam having energy which is higher than that obtained by a synchrotron or storage ring of the same scale based on normal conducting bending magnets can be accelerated or stored.

Figure 4:
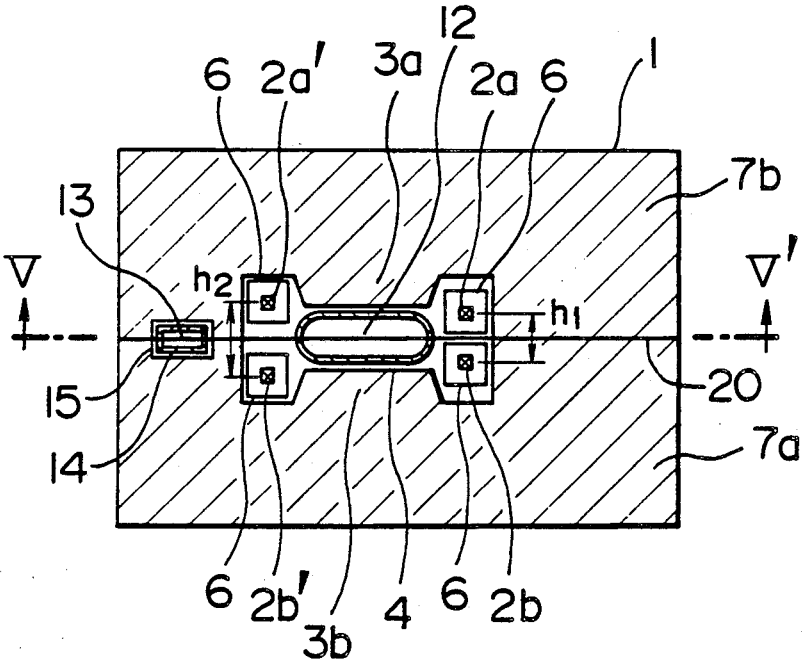
FIG. 4 is a sectional view illustrating a bending magnet according to another embodiment of the invention.
Figure 5:
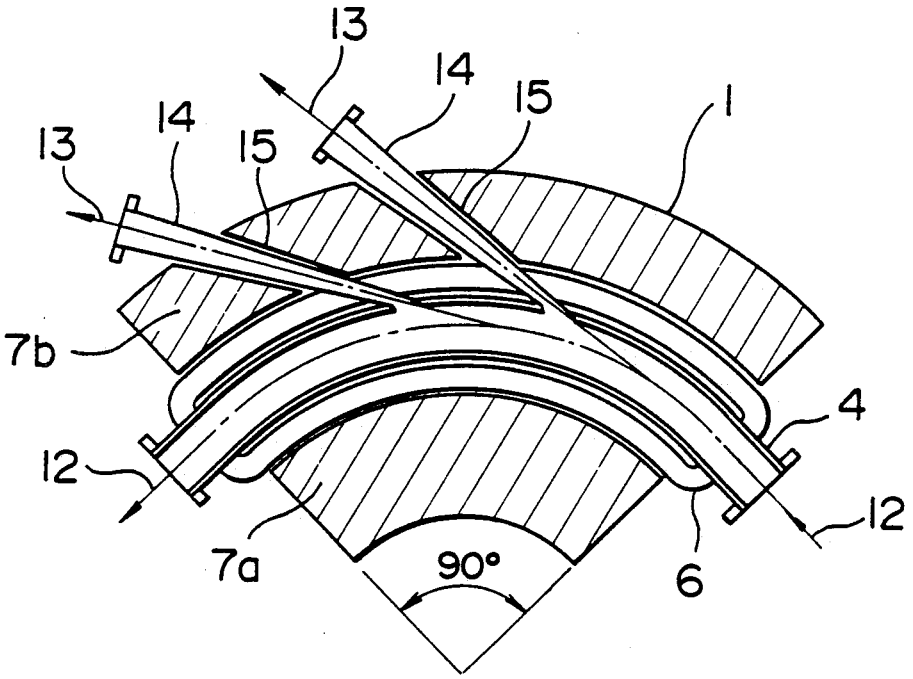
FIG. 5 is a sectional view taken on the line V–V' of FIG. 4.

Referring to FIGS. 4 and 5, a bending magnet according to another embodiment of the invention will now be described.

This embodiment is directed to a bending magnet for an electron synchrotron or storage ring, particularly, in consideration of an application in which the accelerator is used as a synchrotron radiation (SR) source.

As shown in FIG. 4, this embodiment differs from the FIG. 1 embodiment in that tunnels 15 are formed in the outer circumference side return yoke vertically centrally thereof i.e. on a plane containing the orbit of charged particle beam, and guide ducts 14 for radiations 13 radiating tangentially to the orbit of a charged particle beam 12 are provided in the tunnels 15. In this embodiment, the vertical distance $h_2$ between superconducting coil segments 2*a*' and 2*b*' disposed at the outer circumference side of the orbit of charged particle beam 12 is made to be larger than the vertical distance, $h_1$, between superconducting coil segments 2*a* and 2*b* disposed at the inner circumference side of the orbit to equally uniform the magnetic flux passing through the inner and outer circumference side return yokes. By disposing the superconducting coils in this way, a uniform bending magnetic field can be generated in the gap between magnetic poles 3a and 3b for the same reason as in the case of the previous embodiment and besides, a gap can be formed between the cryostats 6 containing the upper and lower coil segments, respectively, disposed at the outer circumference side of the orbit so that the radiation guide ducts 14 can extend to the outside of the core 1 through the gap.

The plan configuration of the bending magnet in accordance with the present embodiment will be better understood when explained with reference to FIG. 5.

FIG. 5 shows a sectional structure of the bending magnet having a bending angle of 90° for the charged particle beam. The value of bending angle is determined similarly to the foregoing embodiment, that is, by dividing 360° by a relatively small integer which is 2 or more and may be different from 90°.

In FIG. 5, two radiation guide ducts 14 extend from a vacuum chamber 4 disposed in the bending magnet. The radiation guide ducts 14 pass through the tunnels 15 in the outer circumference side return yoke 7b tangentially to the orbit of the charged particle beam 12 so as to extend to the outside of a core 1. The inner walls of the radiation guide duct 14 perpendicular to the charged particle orbit are parallel to the tangents of the orbit of charged particle beam 12 in order to decrease the amount of gas discharged from the inner wall under irradiation of the radiation 13. The number of radiation guide ducts 14 may be three or more but must be determined so as not to lead to magnetic saturation of the outer circumference side return yoke 7b and to a great difference in reluctance between the inner and outer circumference side return yokes 7a and 7b in the magnetic circuit comprised of the upper superconducting coil 2a, 2a', lower superconducting coil 2b, 2b' and core 1.

The embodiments of FIGS. 4 and 5, as well as FIGS. 1 and 2 are all capable of generating a uniform bending magnetic field in the gap between magnetic poles 3a and 3b but the kind of charged particle beam to be used differs depending on the application, that is, acceleration or storage as will be described below in brief.

More particularly, where the total energy of a charged particle beam is E, the rest mass of a charged particle is $m_o$, the velocity of light is c and the rest energy of the charged particle beam is $E_o(=m_oC^2)$, the Lorentz factor $\gamma$ representative of the degree of generation of radiation is given by $$\gamma = E/E_o.$$

Since $E_o = 511$ KeV holds for an electron, the electron beam energy approximating a few hundred of MeV or more is a sufficiently high relativistic energy value to obtain $\gamma \gtrsim$ a few thousand, and with the electron the bending magnet can be utilized for a synchrotron radiation source. But with a weighty charged particle such as a proton whose mass is about 2000 times as large as that of an electron, the radiation almost can not be generated unless a proton beam has a very high energy value. Therefore, the bending magnet in accordance with the embodiment of FIGS. 1 and 2 which surrounds radiation guide duct 14 can be utilized as a superconducting bending magnet with a sectoral core and used with a weighty charged particle such as a proton.

A further embodiment of the invention will be described with reference to FIG. 6.

Figure 6:
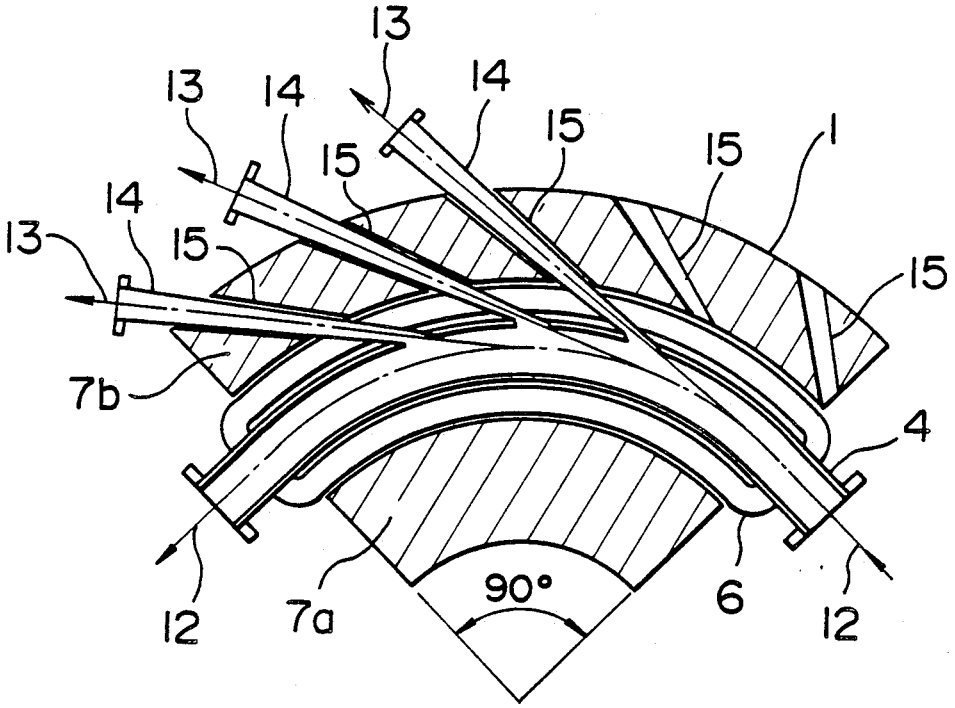
FIG. 6 is a similar view to FIG. 5 illustrating still another embodiment of the invention.

In this embodiment of FIG. 6, five tunnels 15 are formed in an outer circumference side return yoke 7b at circumferentially equi-distant intervals. Radiation guide ducts 14 are disposed in only three of the tunnels at positions which are downstream of the orbit of the charged particle beam 12 and from which the radiation can be guided.

This embodiment adds to the bending magnet of the embodiment shown in FIGS. 4 and 5 such a feature that upstream of the orbit of the charged particle beam 12, a plurality of tunnels 15 are provided in which no radiation guide duct 14 is disposed. Advantageously, with this construction, the cross-sectional structure of the outer circumference side return yoke 7b can be uniformed circumferentially to improve uniformity of the distribution of bending magnetic field in the orbital direction of the charged particle beam.

In the previously-described embodiments, values of the vertical distance $h_1$ between the inner circumference side superconducting coil segments 2a and 2b and the vertical distance $h_2$ between the outer circumference side superconducting coil segments 2a' and 2b' are determined as will be described below.

Firstly, the vertical distance $h_1$ between the inner circumference side superconducting coil segments 2a and 2b is determined by making 30° or less an angle ($\theta$) subtended by a horizontal line 20 passing the charged particle beam 5 and a line connecting the charged particle beam 5 and the center of inner circumference side superconducting coil segment 2a or 2b and by taking into consideration cooling characteristics of the superconducting coil segments 2a and 2b. It has experimentally proven that for $\theta$ being 30° or less, the magnetic field can be uniform using the superconducting coils. On the other hand, the vertical distance $h_2$ between the outer circumference side superconducting coil segments 2a' and 2b' is approximately determined through calculation by reflecting the determined vertical distance $h_1$ between the inner circumference side superconducting coil segments 2a and 2b. Since the radiation guide duct extends through a gap between the upper and lower cryostat segments in the outer circumference side return yoke, the vertical distance $h_2$ is necessarily required to be larger than the diameter of the duct. To precisely determine the vertical distance $h_1$, after the inner radius of the coil is determined in consideration of ambient conditions (such as the size of the magnetic pole), the approximate value based on the calculation is corrected by adjusting the position of the coil segments 2a and 2b vertically.

In accordance with any of the foregoing embodiments the magnetic flux in the vacuum chamber can be distributed uniformly in the radial direction of the bending magnet and over the overall length of the orbit of the charged particle beam and in essentiality, any expedient for making the magnetic flux distribution in the vacuum chamber uniform in the radial direction of the bending magnet and over the overall orbital length of the charged particle beam can be within the framework of the present invention.

As described above, according to the invention, in a bending magnet comprising a core which is substantially sectoral or semi-circular in horizontally sectional configuration and in which opposed magnetic poles are formed and a vacuum chamber for storage of a charged particle beam is disposed in a gap between the opposed magnetic poles, and a pair of upper and lower exciting coils for generating a bending magnetic field in the gap between the magnetic poles of core, the reluctance against the magnetic flux passing through a portion of the core adjacent to the inner circumference of the orbit of the charged particle beam and a portion of the core adjacent to the outer circumference of the charged particle beam orbit is equally uniformed over the overall length of the orbit of the charged particle beam. With this construction, the magnetic flux density becomes uniform in the gap between magnetic poles where the magnetic flux passing through the inner and outer circumference side portions is concentrated and the magnetic flux distribution is uniformed in the orbital direction in the gap, thereby eliminating adverse influence upon the charged particle beam, and the bending magnet can be very effective for use in the synchrotron and storage ring.

We claim:

1. A bending magnet comprising:

a core which is substantially sectoral or semi-circular in horizontal sectional configuration and in which opposed magnetic poles are formed and a gap is formed between said opposed magnetic poles for disposing a vacuum chamber for storage of a charged particle beam; and a pair of upper and lower exciting coils for generating a bending magnetic field in the gap, said pair of exciting coils having a vertical sectional configuration, as viewed along a plane vertical to an orbit of the charged particle beam, which is unchanged over a whole length of the bending magnet in a direction of said orbit and asymmetrical with respect to a line vertically intersecting with a line of said orbit, a vertical distance between said upper and lower exciting coils measured at an outer circumference side of said orbit in said vertical sectional configuration being larger than that measured at an inner circumference side of said orbit, so as to make uniform the distribution of the magnetic flux over the whole length of the bending magnet.

2. A bending magnet according to claim 1 wherein said exciting coil is a superconducting coil.

3. A bending magnet according to claim 1 wherein said core is comprised of a first return yoke adjacent to the outer circumference side of the charged particle beam orbit and a second return yoke adjacent to the inner circumference side of the charged particle beam orbit, and the horizontal width of the first return yoke is smaller than that of the second return yoke.

4. A bending magnet according to claim 1, further comprising at least one tunnel formed in a portion of the core adjacent to the outer circumference side of said orbit to extend between said upper and lower coils and communicate with said vacuum chamber for mounting a synchrotron radiation guide duct extending therethrough.

5. A bending magnet according to claim 4 wherein a plurality of tunnels are formed in a return yoke of said core adjacent to the outer circumference of the charged particle beam orbit so as to be distributed substantially uniformly in the orbital direction of the charged particle beam.

6. A storage ring comprising a plurality of bending magnets, each bending magnet comprising:

a core which is substantially sectoral or semi-circular in horizontal sectional configuration and in which opposed magnetic poles are formed and a gap is formed between said opposed magnetic poles for disposing a vacuum chamber for storage of a charged particle beam; and a pair of upper and lower exciting coils for generating a bending magnetic field in the gap, said pair of exciting coils having a vertical sectional configuration, as viewed along a line tangential to an orbit of the charged particle beam, which is unchanged over a whole length of the bending magnet in a direction of said orbit and asymmetrical with respect to a line vertically intersecting with a line of said orbit such that a vertical distance between said upper and lower exciting coils measured at an outer circumference side of said orbit in said vertical sectional configuration is larger than that measured at an inner circumference side of said orbit;

said storage ring further comprising means for connecting said plurality of bending magnets so as to provide a path for said orbit or the charged particle beam through the vacuum chambers of said plurality of bending magnets and means for injecting the charged particle beam into said path.

7. A storage ring according to claim 6, wherein said core includes a first return yoke adjacent to the outer circumference side of the charged particle beam orbit and a second return yoke adjacent to the inner circumference side of the charged particle beam orbit, and the horizontal width of the first return yoke is smaller than that of the second return yoke.

8. A bending magnet for use in apparatus for an orbiting charged particle beam which comprises in a vacuum chamber a magnetic core which is substantially sectored or semi-circular in configuration in an orbit plane of said charged particle beam with upper and lower poles which are on opposite sides of said beam forming a gap for said beam; and means including upper and lower exciting coils for generating a bending magnetic field in said gap for making uniform the distribution of the magnetic flux both in a radial direction and over the entire length of the bending magnet in a direction along the beam orbit.

9. A bending magnet as defined in claim 8 wherein said exciting coils having a sectional configuration as viewed in a plane perpendicular to said orbit which is unchanged over the entire length of the bending magnet in the direction of said orbit and asymmetrical with respect to a line perpendicular to and intersecting said charged particle beam.

10. A bending magnet comprising:

a core which is substantially sectoral or semi-circular in horizontal sectional configuration and in which opposed magnetic poles are formed and a gap is formed between said opposed magnetic poles for disposing a vacuum chamber for storage of a charged particle beam; and a pair of upper and lower exciting coils for generating a bending magnetic field in the gap, said pair of exciting coils having a vertical sectional configuration, as viewed along a plane vertical to the orbit of the charged particle beam, which is unchanged over a whole length of the bending magnet in a direction of said orbit and asymmetrical with respect to a line vertically intersecting with a line of said orbit so that a vertical distance between said upper and lower exciting coils measured at an outer circumference side of said orbit in said vertical sectional configuration is larger than that measured at an inner circumference side of said orbit, thereby making the distribution of the magnetic flux in the radial direction and the circumferential direction in the bending magnet substantially uniform over the whole length of the bending magnet.

* * * * *